United States Patent [19]

Marwick

[11] Patent Number: 4,869,764

[45] Date of Patent: Sep. 26, 1989

[54] LUBRICANT EMULSION

[75] Inventor: William F. Marwick, Byfield, England

[73] Assignee: Alcan International Limited, Montreal, Canada

[21] Appl. No.: 137,241

[22] Filed: Dec. 23, 1987

[30] Foreign Application Priority Data

Dec. 29, 1986 [GB] United Kingdom ..... 8630971

[51] Int. Cl.[4] ..... B32B 31/00

[52] U.S. Cl. ..... 156/196; 29/469.5; 72/42; 156/280; 156/281; 156/314; 156/316; 156/319; 252/34; 252/49.5

[58] Field of Search ..... 29/469.5; 156/196, 314, 156/280, 316, 281, 319; 72/42; 252/34, 49.5

[56] References Cited

U.S. PATENT DOCUMENTS

| | | | |
|---|---|---|---|
| 3,505,844 | 4/1970 | McLean | 252/49.5 |
| 3,715,312 | 2/1973 | Teeter et al. | 252/49.5 |
| 4,398,984 | 8/1983 | Uchiyama et al. | 156/196 |
| 4,461,712 | 7/1984 | Jonnes | 72/42 |

*Primary Examiner*—John J. Gallagher
*Attorney, Agent, or Firm*—Cooper & Dunham

[57] ABSTRACT

A metal-working lubricant comprises an aqueous emulsion of (a) a long-chain aliphatic ester, amide, alcohol or acid, and (b) as a fugitive emulsifier an ammonium or volatile amine salt of a long-chain aliphatic acid. On application to sheet, e.g. of aluminum metal with a chromate or anodic oxide protective surface layer, the water and ammonia or volatile amine evaporate to leave a storage-stable hydrophobic lubricant. The sheet can be formed or made into adhesively bonded structures of shaped components.

13 Claims, No Drawings

LUBRICANT EMULSION

This invention relates to lubricant emulsions, particularly those intended to form in situ metal-working lubricants, for example those used for press-forming metal sheets. There is current interest in techniques for producing adhesively bonded structures of shaped aluminum components for use in the automotive industry. Such a technique is described for example in EPA No. 127343. The lubricants of this invention are suitable for use in such techniques. The technique of converting a coil of aluminum metal sheet into a structure of shaped components for use in the automotive industry may typically involve the following steps:

The metal surface is pre-treated to provide a strongly bonded inorganic protective layer thereon which acts as a base for subsequently applied adhesive.

A lubricant is applied to the treated metal coil. The coil may then be stored or transported, with the lubricant serving to protect the treated metal surface, and is cut up into pieces ready for pressforming.

The pieces of metal sheet are press-formed into components of desired shape. In this context, press-forming involves mainly drawing but also stretching operations. This and subsequent operations are all performed on an automobile production line.

Adhesive is applied to selected areas of the shaped components, without first removing the lubricant.

The components are assembled into the shape of the desired structure, and may be spot welded to give the structure green strength.

The adhesive is cured at elevated temperature.

The metal surfaces of the structure are subjected to an aqueous alkaline cleaner which removes the lubricant.

The structure is painted.

A lubricant for use in such a technique needs to fulfil several requirements:

(a) The lubricant must, obviously, have suitable lubricating properties for the press-forming operation.

(b) The lubricant should be solid at likely metal storage temperatures. A film of lubricant that is liquid is unlikely to remain evenly distributed on the coil.

(c) The lubricant should not damage the inorganic pretreatment layer on the surface of the metal, even on storage under conditions of high humidity.

(d) Since it is not practical in a production line to remove lubricant prior to application of adhesive, the lubricant needs to be compatible with the adhesive.

(e) After the adhesive has been applied and cured, the lubricant should be readily removable by an aqueous alkaline cleaner of the type conventionally used to prepare metal surfaces for painting.

Our European Patent Application No. 86309498 describes a lubricant which fulfils many of these requirements, comprising at least one ester of a polyhydric alcohol having two or three hydroxyl groups of which one or two are esterified with a long chain carboxylic acid. The lubricant is primarily intended to be applied to metal sheet in solution in a volatile hydrocarbon solvent, but this is hazardous in a large scale operation.

A commercially available lubricant Crodalube MA10 (marketed by Croda Metal Treatments Limited, Doncaster, England) comprises a mixture of a glyceryl monoester of a fatty acid together with coconut oil, emulsified in water by means of a sodium alkyl benzene sulphonate emulsifier. After application of the emulsion and evaporation of the water, it is found that the very hydrophilic emulsifier damages the inorganic pretreatment layer on the aluminum metal surface.

It is an object of this invention to provide a metal-working lubricant that can be applied from aqueous emulsion, but which is not liable to damage an inorganic pretreatment layer on aluminum metal even on storage under humid conditions. This object is achieved by the use of a figitive emulsifier. The use of fugitive emulsifiers is known in other fields for example in the manufacture of emulsion wax floor polishes, where it is desired that the applied and dried polish be water-resistant, but it is believed not previously in the field of metal-working lubricants.

In one aspect the invention provides an aqueous emulsion of (a) at least one long-chain aliphatic ester, amide, alcohol or acid, and (b) an ammonium or volatile amine salt of a long-chain aliphatic acid in a concentration to stabilise the emulsion, the emulsion having the property of forming, on evaporation of water and ammonia or volatile amine, a lubricant suitable for metal-working.

The metal-working lubricant is preferably suitable for press-forming, particularly for those press-forming operations that involve mainly drawing rather than stretching. The lubricant is preferably also compatible with the sort of adhesives, usually single part heat-cured paste epoxy adhesives, that are likely to be used in automobile production lines. All lubricants reduce adhesive bond strength; a lubricant is said to be adhesive compatible if the strength of the fresh adhesive bond prepared in the presence of lubricant is at least 50%, preferably at least 70%, of that prepared in the absence of lubricant.

Component (a) is preferably based on a saturated C8 to C18 monocarboxylic acid. More preferably, it is an ester of such an acid with a monohydric or polyhydric alcohol. The component may with advantage be a partial ester of a di- or polyhydric alcohol with such an acid, particularly with a saturated C10 to C14 monocarboxylic acid, a particularly preferred example being ethylene glycol monolaurate.

These preferences are based on several factors. Esters may have marginally better lubricating performance in press-forming than amides, alcohols or acids of comparable molecular weight. If the long-chain aliphatic group is too short, lubricating properties may be poor; if it is too long, adhesive-compatibility may be reduced. There is a general inverse correlation between ester molecular weight and adhesive compatibility. Alcohols with more than about three polar groups, such as pentaerythritol and polyethylene glycol tend to encourage migration of water into the adhesive joint, and can therefore be said to be less adhesive-compatible than mono-, di- or trihydric alcohols. Partial esters, i.e. those having free hydroxyl groups, generally have higher melting points than full esters of comparable molecular weight, and so permit formulation of lubricants that are solid at ambient temperature; but hard lubricants of high melting point tend to favor stretching operations rather than the drawing operations which are more common in press-forming on a production line. Mixtures of components may be used in order to achieve an optimum combination of desired properties.

Component (6) is the fugitive emulsifier. It may be a salt of ammonia or a volatile amine with a longchain aliphatic acid, preferably a saturated C8 to C18 monocarboxylic acid. A preferred emulsifier is ammonium stearate. The emulsifier is preferably used in an amount of from 5 to 20% by weight of the non-volatile ingredients of the emulsion. The non-volatile ingredients may constitute from 10 to 60% of the emulsion to provide a convenient application viscosity, towards the lower end of this range for spraying and towards the higher end for roll coating.

The emulsion can be formed simply by dissolving the requisite amount of ammonia or volatile amine in water, heating a mixture of this with the component (a) and the long-chain aliphatic acid of component (b) and stirring the mixture rapidly to form a stable emulsion. On application of the emulsion to a metal surface, the water and ammonia or volatile amine evaporate off leaving a lubricant mixture of component a) with the long-chain aliphatic acid. This lubricant is preferably solid or semi-solid at ambient temperature, e.g. melting at 20°–50° C., to avoid problems with smearing and blocking during coiling, decoiling, slitting and cutting. The use of a lubricant which is solid at ambient temperature avoids contamination of the metal surface with a possibly adhesive-incompatible oil or contaminant and prevents local build up of lubricant to an undesirably thick layer. For this purpose, it is not necessary that component (a) has a high melting point; it is the combination of component (a) with the long chain aliphatic acid of component (b) that determines the melting point of the lubricant.

The lubricant may melt at a temperature low enough to permit its removal from a metal surface by an aqueous alkaline cleaner, such as is used in automotive production lines to prepare metal parts for painting. The highest practicable temperature for aqueous alkaline cleaners in such circumstances is about 70° C. Lubricants melting below 70° C. and preferably below 65° C., can thus always be removed by aqueous alkaline cleaners. Lubricants melting above 70° C. may or may not be removable depending on whether they have chemical groups, e.g. hydroxyl groups, which can react with the alkali to assist removal from the metal surface. Thus for example, a commercially available wax having a melting point of 85° C. and an acid number of 135 to 155 by DIN 53402, was found not to be removable by aqueous alkaline cleaners. On the other hand, glycerol monostearate, having a melting point of 81° C. and two free hydroxyl groups per molecule, is removable by aqueous alkaline cleaners. A lubricant is deemed removable by aqueous alkaline cleaners if it can be removed by treatment for 2 minutes at 70° C. with a 15% by weight aqueous solution of Ridoline 160 (a silicate-based proprietary cleaner marketed by I.C.I. plc).

Depending on its intended use, the lubricant may need to be compatible with subsequently applied adhesive. In general, the esters and other components (a) described herein are compatible as a result of being either absorbed or displaced by subsequently applied adhesive without grossly impairing the adhesive bond strength obtainable. By contrast, resinous lubricants and metal soap lubricants are generally not adhesive compatible in this sense.

In another aspect, the invention provides a method of forming a metal sheet by the steps of applying to the metal sheet on aqueous emulsion as herein described, removing the water and ammonia or volatile amine, and subjecting the lubricated metal sheet to a forming operation.

In yet another aspect, the invention provides a method of forming a structure of shaped aluminum components comprising the steps:

pretreating an aluminum sheet to provide a strongly-bonded inorganic protective layer thereon which acts as a base for subsequently applied adhesive, applying to the pretreated sheet an aqueous emulsion as herein described and evaporating off the water and ammonia or volatile amine.

press-forming pieces of the lubricated sheet into aluminum components, applying adhesive to the components, bringing the components together in the shape of the desired structure, and curing the adhesive.

The structure so produced may be subjected to the action of an aqueous alkaline cleaner to remove lubricant prior to painting.

The term "aluminum" is used herein to include, not only the pure metal, but also Al rich alloys, particularly those of the kinds envisaged for vehicle construction such as the 2000 and 5000 and 6000 Series of the Aluminum Association Inc. Register.

The metal sheet needs to have adequate strength for its intended use, but should not be so rigid that it cannot pass round the rolls used in continuous surface pretreatment. Metal sheet thickness should normally be 0.7 to 3.0 mm preferably 1.2 to 2.5 mm, depending to some extent on the alloy used.

Formation of the strongly bonded protective layer involves pretreatment of aluminum in coil form. The metal is said to be in coil form when it is a sheet of indefinite length. Such sheet is normally coiled for convenience of storage; for the pretreatment, it has, of course, to be temporarily uncoiled. In order that the pretreatment may be truly continuous, the back end of one coil may be joined to the front end of the next. This pretreatment replaces the oxide layer that is ordinarily present on aluminum in air by an artificially applied surface layer. This artificial layer is very thin, typically less than 0.4 microns. The chemical composition of this layer is variable and is not always easy to determine. It may for example be an oxide layer or a conversion coating such as a chromate conversion coating.

The surface pretreatment is subject to several requirements. It must be suitable for application to metal drawn from coil, which means that it must be reasonably fast; conventional phosphoric acid anodizing is not preferred for this reason. The resulting surface layer must not be destroyed by subsequent operations including forming, curing of adhesive, and perhaps also preparation for painting. Also, the surface layer must be compatible with adhesive and perhaps also with paint.

The inorganic pretreatment layer should be sufficiently thick to provide a sound base for reliable strong and durable adhesive joints between pieces of the metal. Also, the pretreatment layer should be thick enough to withstand extended storage, in the presence of lubricant. Pretreatment layers that are too thick not only cost more but may (depending on the pretreatment) crack or craze, on drying and/or when the metal sheet is press-formed. Also, if the pretreatment layer is too thick, its electrical resistance may also be so high that spot welding is difficult. The pretreatment layer is generally applied at a dry rate of 0.03 to 1.0, preferably 0.1 to 0.5, grams per square metre, the optimum thickness depending on the nature of the pretreatment.

One suitable pretreatment is that marketed by Pyrene Chemical Services Ltd. under the Trademark Bonderite 735. This may be used to deposit 0.03 to 0.9, preferably from 0.1 to 0.3, grams per square metre of surface layer which results in adhesive joints of good strength and durability. The surface layer is believed to consist essentially of hydrated chromium phosphate, with small amounts of chromium oxide and aluminum fluoride present close to the aluminum/conversion coating interface. A recommended process sequence is spray acid clean, spray water rinses, spray application of conversion coating, spray water rinses, hot air drying.

Another preferred pretreatment is that marketed by Albright & Wilson Limited under the Trademark Accomet C. This is a "no rinse" treatment and is of particular interest for coil coating purposes as it involves roller application of a chromate based coating which is non-reactive and requires no subsequent rinsing. This minimises the effluent treatment required and makes the process relatively simple to control. A recommended process sequence is spray acid clean, spray water rinses, roller-coat application of Accomet C, dry.

Other suitable pretreatments include alternative chromate-phosphate coatings such as that marketed by I.C.I. under the Trademark Alodine 407/47. Also suitable are anodizing treatments, for example AC anodizing in hot sulphuric acid (British Patent Specification No. 1235661), and the various treatments described in GB No. 2139540 A.

The aqueous emulsion of this invention is applied to the so pretreated aluminium sheet, and the water and ammonia or volatile amine evaporated off. While enough lubricant should be used to provide protection during storage and lubrication during press-forming, too much lubricant may reduce the strength of adhesive bonds subsequently obtainable.

The aluminum metal sheet carrying the protective layer and the lubricant is cut into pieces of desired size. Generally, it will need to be stored for periods up to several months, either before or after being cut up. It is known that inorganic pretreatment layers on aluminum are susceptible to damage on storage, probably by hydrolysis. For this reason, it is usual practice not to store pretreated aluminum for any length of time, but rather to apply immediately some other material such as paint, lacquer or adhesive. In principle, a layer of lubricant ought to be capable of protecting the pretreatment layer from hydrolysis. In practice, if the lubricant is applied as an aqueous emulsion with a conventional emulsifier, it may spoil rather than enhance the storage stability of the pretreatment layer. This is believed to be due to the hydrophilic emulsifier drawing moisture towards the pretreatment layer. A similar effect is believed to occur after application and curing of adhesive; the emulsifier, still present adjacent the adhesive joint, draws moisture towards the joint and by causing hydrolysis of the pretreatment layer progressively weakens the adhesive bond.

Lubricants of this invention are found to provide satisfactory protection, so that the protective layer is storage stable for these periods, even under conditions of high humidity, and continues to act as an effective base for subsequently applied adhesive.

The pieces of metal sheet are then press-formed into components. Thereafter, without intermediate removal of the lubricant which would be impractical on a production line, an adhesive is applied to selected areas of the components.

The adhesive must, of course, form strong reliable bonds between components, notwithstanding the presence of lubricant, and these must be capable of retaining their strength under the wide variety of conditions, (for example, in the case of structures for motor vehicles, under conditions of temperature, humidity, corrosion, that motor vehicles generally encounter for a time at least equal to the useful service life of the vehicle). In addition, the adhesive must show these properties on the surface pretreated components.

The adhesive needs to be curable, under conditions which do not damage the structure, to a state which is strong without being brittle. The required impact resistance may be achieved by including a toughening agent, e.g. a rubbery phase, in the adhesive.

Although these requirements are quite stringent, it is not too difficult to find commercially available products that meet them. Different companies sell acrylic, vinyl plastisol, epoxy, and elastomeric adhesives, and among these, single part heat-cured paste epoxy adhesives are preferred.

When the components, coated where necessary with uncured adhesive, are assembled, the assembly needs to be held prior to and during curing of the adhesive. This may be done by means of a jig or by riveting, but a more convenient technique for a mass production line is spot welding. The spot welds also act as peel stoppers. This combination of adhesion and spot welding, known as weldbonding, is described in a paper T17 published by the Aluminum Association in 1978 entitled "Weldbonding—an alternative joining method for aluminum autobody alloys", and is also referred to in GB No. 2139540A.

The adhesive needs to be cured under appropriate conditions, e.g. ten to thirty minutes at 150° to 180° C., to form the desired structure. If the structure is to be painted, the next step is a cleaning step which may be conventional, for example an inhibited alkaline cleaner inter alia for the purpose of removing lubricant. The inorganic pretreatment layer should be chosen such that it is not destroyed or seriously damaged by this cleaning step. Finally a paint coating is applied. Again, the bonded protective layer must be compatible with any paint coating applied and must form a sound substrate for such paint coating.

The following examples illustrate the invention.

EXAMPLE 1

Various lubricants were tested for compatibility with adhesive. Lubricant emulsions were made up to the formula:

18 parts by weight of ester (See Table ),
2 parts by weight of stearic acid,
80 parts by weight of a 5% solution of ammonia in water.

The components were heated and mixed and stirred rapidly to form a stable emulsion. Each lubricant emulsion was applied to aluminum metal sheet which had been pretreated with a no-rinse chromate (VI) conversion coating at a level of about 6 g/m$^2$. The emulsion was evaporated to leave a rather uniform film of lubricant on the metal which was cut into 100 mm×20 mm coupons and assembled into single lap joints with 20 mm×10 mm overlap. As adhesive there was used a single-part epoxy XMG 38 (National Adhesives, Slough). Joint strengths were as follows:

| Ester | Lubricant Coatweight g/m² | Joint Strength MPa |
|---|---|---|
| Glyceryl Monolaurate | 6.2 | 19.6 |
| Pentaerythritol Monostearate | 6.6 | 17.0 |
| Ethylene Glycol Monolaurate | 7.2 | 16.6 |
| Glyceryl Monopalmitate | 4.2 | 16.3 |
| Ethylene Glycol Monostearate | 6.0 | 14.7 |
| Glyceryl Dipalmitate | 5.5 | 13.4 |
| Propylene Glycol Distearate | 5.3 | 12.6 |
| No Lubricant | | 21.7 |

The compatibility of a lubricant with the adhesive may be assessed by noting how much the joint strength is reduced in the presence of the lubricant. Note that compatibility of lubricant with adhesive is broadly speaking inversely related to lubricant molecular weight, and more specifically inversely related to the size of the hydrophobic segment of the ester. High molecular weight hydrocarbon lubricants such as H 7002 (Edgar Vaughan, Birmingham) have limited compatibility with single part epoxy adhesives, especially the high viscosity adhesives that are often useful in applications requiring high impact strengths. Low molecular weight hydrocarbons such as octadecane are not good press-forming lubricants.

In a similar test performed using a single part tape adhesive XB5006 (Ciba-Geigy, Duxford) the criteria for adhesive compatibility were somewhat different. Weaker joints were obtained with lubricants having large hydrophilic segments in the esters, namely propylene glycol distearate and pentaerythritol monostearate.

EXAMPLE 2

This example concerns lubricant compatibility with the strongly bonded inorganic protective layer applied to the aluminum sheet as a pretreatment.

Samples of 1.6 mm gauge aluminum AA5251 alloy sheet were subjected to two different pretreatments:

(i) dip-applied chromate (VI) conversion coating, Bonderite 735 (Pyrene Chemical Services Limited, Iver, Bucks.) applied at a level of 200 mg/m².

(ii) hot a.c. phosphoric acid anodizing for ten seconds in a 45° C. bath at 600 A/m² current density.

Three different lubricants were applied to these pretreated sheets, which were then cut up into 100 mm×20 mm coupons and bonded with single-part epoxy adhesive ESP 105 (Permabond, Southampton) to give 10 mm×20 mm single lap joints.

Because the purpose of the experiment was to check compatibility on storage with the inorganic protective layer, the first two lubricants in the following table were applied from solution in an organic solvent. Both aqueous emulsions and organic solvent solutions are known to be compatible in the short term with the inorganic protective layers. Joint strengths were measured with three different joint and adhered histories as follows:

| Lubricant | Pretreatment | A | B | C |
|---|---|---|---|---|
| | anodic | 19.4 | 19.8 | 13.2 |

-continued

| Lubricant | Pretreatment | A | B | C |
|---|---|---|---|---|
| cyclohexyl stearate(4 p.b.w) plus decanediol(1 p.b.w) | chromate | 18.4 | 17.8 | 9.3 |
| | anodic | 19.8 | 19.1 | 8.9 |
| ethylene bis-stearamide (4 p.b.w) plus stearic acid(1 p.b.w) | chromate | 19.6 | 18.3 | 5.9 |
| | anodic | 18.5 | 2.5 | 1.3 |
| Crodalube MA10 | chromate | 19.0 | 11.9 | 5.7 |
| | anodic | 21.2 | 20.8 | 12.8 |
| no lubricant | chromate | 21.1 | 12.8 | 6.9 |

p.b.w. = parts by weight
where A is freshly lubricated adherends in a freshly cured joint.
B is a freshly cured joint made from adherends stored for six weeks at a 25 C., 98% relative humidity after lubricating.
C is a joint made as in B and then aged in neutral salt spray (40 C., 5% sodium chloride) for eight weeks.

Lubricant compatibility with the protective pretreatment layer can be assessed by comparing the joint strength without lubricant (last row) with that in the presence of lubricant. From column A, it appears that all the lubricants tested were compatible with the adhesives, for the joint strengths are all satisfactory. From column B, it appears that the Crodalube MA10 lubricant was not compatible with the protective pretreatment layers, for the joint strengths with that lubricant are poor. It will be recalled that Crodalube MA10 is a lubricant emulsion containing a permanent sodium alkyl benzene sulphonate emulsifier. The lubricants in the first two rows of the table did not contain a permanent emulsifier; they did not damage the protective pretreatment layer on storage, and in some cases even exerted a protective effect on the layer so as to increase the adhesive strengths obtained after storage. Column C shows that the satisfactory results reported in column B, are to a substantial extent retained after storage of the joints in a corrosive environment.

EXAMPLE 3

Samples of 1.6 mm gauge aluminum 5251 alloy sheet were pretreated with Accomet C, a chromate containing coil-applied pretreatment from Albright & Wilson plc, to a coatweight of approximately 150 mg/m². Two lubricants were applied to this sheet: the first was Crodalube MA10 (as described earlier) and the second was a water based emulsion with a fugitive emulsifier as described in the invention; the formulation was:

| | |
|---|---|
| ethylene glycol monolaurate: | 18 parts by weight |
| stearic acid: | 2 parts by weight |
| 5% ammonia in water: | 80 parts by weight |

The components were heated and mixed and stirred rapidly to form a stable emulsion. This lubricant is referred to below as EGML.

The lubricated sheet was cut and assembled into lap-joints as in example 2, using Epoxyweld 7060, a single part paste epoxy from Evode Limited, Stafford. Joint strengths were measured with five different joint and adherend histories as follows:

| Lubricant | Coatweight | A | B | C | D | E |
|---|---|---|---|---|---|---|
| MA10 | 5 g/m² | 22.1 | 18.5 | 17.6 | 17.3 | 13.5 |
| EGML | 5 g/m² | 23.7 | 20.6 | 19.5 | 19.4 | 18.4 |

where

A is freshly lubricated adherends in a freshly cured joint

B is freshly lubricated adherends in a joint which was cured and exposed to neutral salt spray (5% sodium chloride at 43° C.) for twenty weeks C is a freshly cured joint made from adherends stored for two months at 25° C., 98% RH after lubricating.

D is a joint made as in C and then exposed to neutral salt spray for four weeks

E is a joint made as in C and then exposed to neutral salt spray for twelve weeks It is once again clear that, whether the hostile environment is experienced by the joint before or after adhesive cure, the strength reduction is always less for EGML, the lubricant with the fugitive emulsifier. Crodalube MA10 has a permanent emulsifier but is also based on a laurate ester and the beneficial effect of the invention is thus evident.

I claim:

1. A method of forming a structure of shaped aluminum components comprising the steps of:

pretreating an aluminum sheet to provide a strongly bonded inorganic protective layer thereon which acts as a base for subsequently applied adhesive, applying to the pretreated sheet an aqueous emulsion of (a) at least one long-chain aliphatic ester, amide, alcohol or acid, and (b) an ammonium or volatile amine salt of a long-chain aliphatic acid in a concentration to stabilise the emulsion, the emulsion having the property of forming, on evaporation of water and ammonia or volatile amine, a lubricant suitable for metal working, and evaporating off the water and ammonia or volatile amine, press-forming pieces of the lubricated sheet into aluminum components, applying adhesive to the components, bringing the components together in the shape of the desired structure, and curing the adhesive.

2. A method as claimed in claim 1, comprising the additional steps of subjecting the structure to the action of an aqueous alkaline cleaner and thereafter painting the structure.

3. A method of forming a metal sheet by the steps of applying to the metal sheet an aqueous emulsion of (a) at least one long-chain aliphatic ester, amide, alcohol or acid, and (b) an ammonium or volatile amine salt of a long-chain aliphatic acid in a concentration to stabilise the emulsion, the emulsion having the property of forming, on evaporation of water and ammonia or volatile amine, a lubricant suitable for metal working, removing the water and ammonia or volatile amine, and subjecting the lubricated metal sheet to a forming operation.

4. An aqueous emulsion of (a) at least one long-chain aliphatic ester, amide, alcohol or acid, and (b) an ammonium or volatile amine salt of a long-chain aliphatic acid in a concentration to stabilise the emulsion, the emulsion having the property of forming, on evaporation of water and ammonia or volatile amine, a lubricant suitable for metal-working.

5. An emulsion as claimed in claim 4, wherein component (a) is an ester of a saturated C8–C18 monocarboxylic acid.

6. An emulsion as claimed in claim 4 wherein component (a) is a partial ester of a di- or polyhydric alcohol with a saturated C10–C14 monocarboxylic acid.

7. An emulsion as claimed in claim 6, wherein component (a) is ethylene glycol monolaurate.

8. An emulsion as claimed in claim 4 wherein component (b) is ammonium stearate.

9. An emulsion as claimed in claim 4 wherein component (b) is present in an amount of 5–20% of the non-volatile ingredients.

10. An emulsion as claimed in claim 4 wherein the lubricant is solid or semi-solid at ambient temperature.

11. An emulsion as claimed in claim 10, wherein the lubricant has a melting temperature in the range 20°–50° C.

12. An emulsion as claimed in claim 4, wherein the lubricant is suitable for press-forming.

13. An emulsion as claimed in claim 4, wherein the lubricant is compatible with single part heat-cured paste epoxy adhesives.

* * * * *